United States Patent [19]

Feldstein

[11] 4,180,809

[45] Dec. 25, 1979

[54] ELECTRONIC SIREN

[75] Inventor: Robert S. Feldstein, Pelham Manor, N.Y.

[73] Assignee: Abex Corporation, New York, N.Y.

[21] Appl. No.: 916,155

[22] Filed: Jun. 16, 1978

[51] Int. Cl.[2] ..... G08B 5/00

[52] U.S. Cl. ..... 340/384 E; 340/384 R

[58] Field of Search ..... 340/384 E, 384 R, 70

[56] References Cited

U.S. PATENT DOCUMENTS 3,905,016 9/1975 Peterson ..... 340/384 E

*Primary Examiner*—Harold I. Pitts

*Attorney, Agent, or Firm*—Millard, Cox & Smith

[57] ABSTRACT

An electronic siren wherein push-pull output transistor stages are used to drive an inductive load for producing an audible signal. Thermally induced base leakage currents are diverted from the transistor stages through the use of a control network which alternately removes a constantly asserted forward biasing signal therefrom. A current diverting network operating in conjuction with a series connected common emitter resistor serves to limit excess current flow at the output transistor stages and a shutdown network responding to a non-saturated on condition at either transistor stage serves to shut the circuit down in the event of short circuits and the like.

20 Claims, 1 Drawing Figure

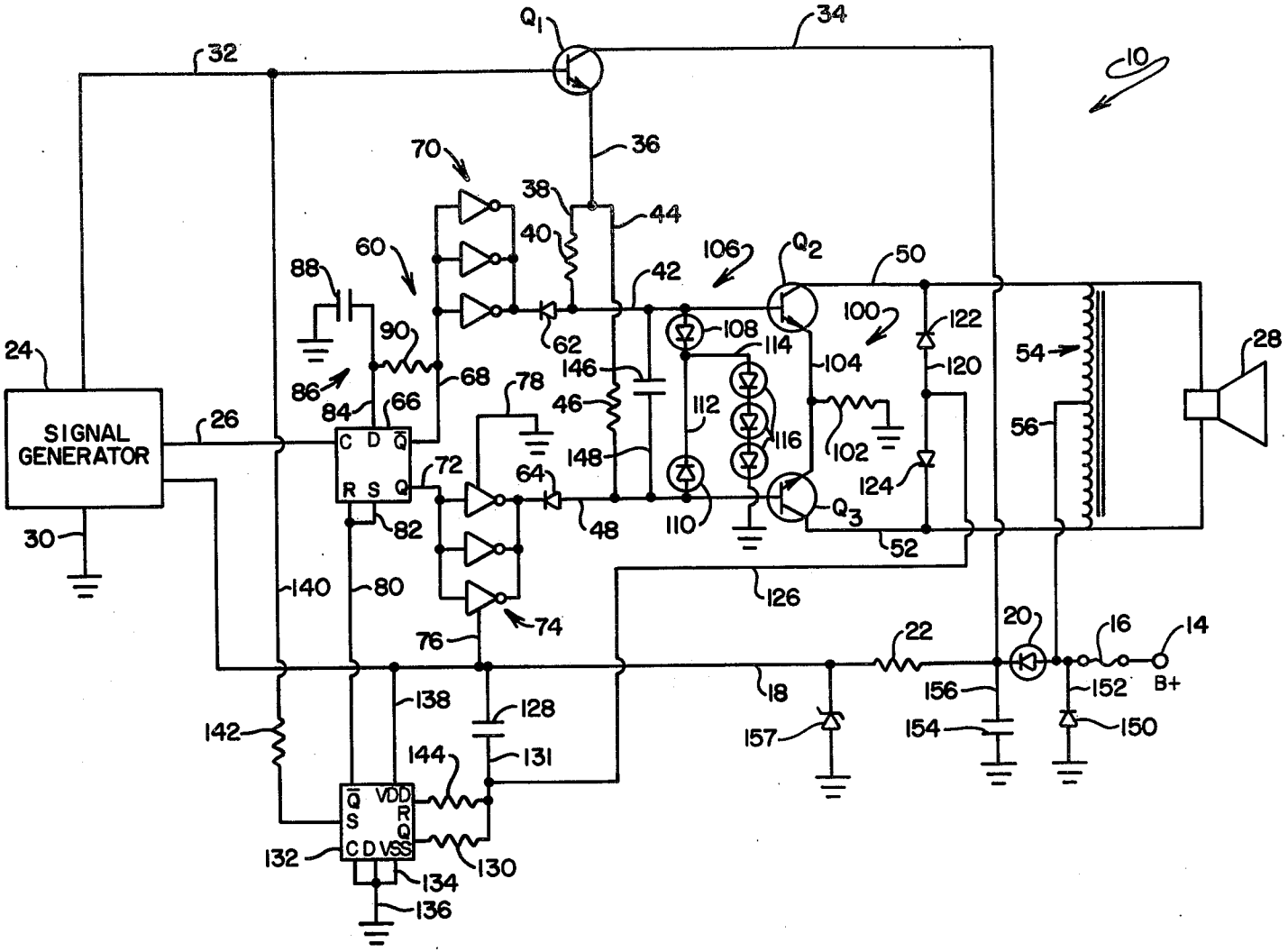
SIGNAL GENERATOR
B+
VDD
VSS

ELECTRONIC SIREN

BACKGROUND

Electronic sirens have found a high degree of acceptance in the marketplace, due in part to the flexibility of audio output available in their design. For example, the frequencies developed may be programmed to achieve an output highly perceptible to the human auditory response system. Further, inasmuch as the output of the devices is derived from an audio frequency electrical signal as opposed to mechanical devices, compact units are available which are ideally suited for vehicular installation.

Generally, the circuits utilized for the sirens include a signal generator which develops a pulse train, for example, a square wave output modulated in frequency and time envelope to achieve such special affects as "wail", "yelp" or "hi/lo". By way of further description, the yelp signal may be developed as a frequency sweep of about 650 $H_z$ to 950 $H_z$ carried out at a rate of three sweeps per second. Similarly, the hi/lo output represents a one second time envelope jump in frequency from 650 $H_z$ to 950 $H_z$, while wail usually is developed as a four second frequency sweep in a range, for example of about 650 $H_z$ to 950 $H_z$. As is known to those artskilled, generation of these outputs is a matter of somewhat straightforward electronics design, typical signal generators being described, for example, in U.S. Pat. Nos. 3,747,092; 3,504,364 and others.

Typically, the pulse train outputs are directed through a form of push-pull power transistor stages and an output or coupling transformer to a speaker, the latter components representing a reactive load. The speaker components of the systems essentially always are mounted for performance under somewhat rigorous environmental conditions. For example, when mounted upon vehicles they are subject to vibrations often of magnitudes causing short circuiting as a consequence of broken lead connections, the speaker coil being momentarily driven into the frame etcetra. When operated under inclimate weather conditions, whether mounted upon vehicles or the exteriors of buildings, rain and/or splashed water and snow may be driven by wind into the speakers, a situation again creating distinct possibilities for short circuiting phenomena to occur. These short circuits typically result in the destruction of the power transistor stages, the correction of which involves relatively high repair costs.

Generally, the power transistors are provided an excess base drive for the practical purpose of minimizing $V_{CE\,SAT}$, to overcome gain variations in evidence in the individual output transistors and to accommodate for operational variations derived from temperature effects. Upon the occasion of a short across the load, the excess base drive will cause very large currents to flow through the power transistors. Inasmuch as transformer impedance is very low under short circuit conditions, collector voltages will approach supply voltage. The resultant voltage-current product then exceeds the region of safe operation of the transistors with the consequence of destroying them by forward bias secondary breakdown. Such destruction occurs in mere milliseconds, a rate far exceeding the operational protective capability of a conventional fuse. Resort to the use of a base voltage clamping network may occur to those art skilled as a solution to the above condition, however, the base-emitter voltage witnessed during operation of the power transistors is not sufficiently predictable nor is the characteristic slope thereof adequate for the operation of a fixed threshold clamp.

Whether occasioned by overload, short circuit phenomena or simply by operation within a hot environment, the power transistors will develop thermally induced leakage currents. Unchecked, these thermally generated base currents will tend to increase until a destructive phenomena termed in the art as "thermal runaway" is experienced. Further aggravating performance under adverse thermal conditions, the most desirable, compact electronic packaging configurations do not have a heat disipation capacity capable of accommodating thermal buildup at the power transistors. In the past, base connected impedance networks have been utilized to divert thermal-leakage currents, however, impractically low resistance values for the networks were required to accommodate all effects encountered. As another aspect of the utilization push-pull power transistor stages, it is important that the activation of these stages be in mutual isolation. In this regard, the drive utilized to turn on the transistors in required alternating fashion should be "non-overlapping", inasmuch as activation of both transistors simultaneously will evolve transformer currents which produce opposing magnetic fields. This produces a reduction in primary impedance during the overlap interval which will result in substantial current spikes at a time when the collector-emitter voltage is not minimum. Such conditions cause substantial heating which will slowly degrade the performance of the output or power transistors.

SUMMARY

The present invention is addressed to an improved electronic siren wherein a pair of output transistors are alternately turned on and off to drive the inductive load of an audio speaker. These output transistors are forwardly biased by a continuous signal asserted from a solid state switch. However, to achieve the desired oscillatory performance of the transistors, a control network is provided which alternately diverts the bias signal through a low impedance path. As a consequence of this arrangement, thermally induced leakage currents extant at the output transistors are diverted during the non-duty portion of each half cycle of operation.

As a further feature and object of the invention, the control network provided for alternately diverting forward bias signals from the two output transistor stages preferably is present as a solid state binary divider or D flip-flop operating in conjunction with solid state junction type unidirectional conductors such as diodes and further includes buffer inverters. With such circuit structure, the system also may incorporate a shutdown feature protecting the output transistor stages from destruction due to thermal runaway effects, short circuits and the like.

As another feature of the invention, a form of soft current limiter is provided in the form of a current monitoring impedance coupled in common series relationship with each of the emitter electrodes of the output transistor stages. Additionally, the limiter includes a current diverter network of predetermined non-linear impedance value which is connected to ground across the base input electrodes of the transistor stages. By selecting the values for the components, the diverter network will progressively divert the asserted forward bias signal, in the presence of emitter current derived voltage levels, at a preselected current level. Thus, excessive current levels are avoided at the output power stages.

As another object of the invention, a shutdown feature is provided wherein a nonsaturated condition of operation of the output transistor stages is detected by a voltage level detector arrangement which monitors the voltage levels at the collector electrode of the output stage. Through the continuous removal of a charge asserted at a capacitor memory in consequence of an output transistor stage saturated condition and the non-removal of the asserted charge in the presence of an unsaturated condition, a detector arrangement is provided which permits the activation of a shutdown network. This shutdown network operates to cause the control network of the system to draw the asserted output transistor forward bias signals through a low impedance diversionary path.

As another object of the invention, overlapping actuation of the output transistor stages is avoided through the utilization of an RC derived interval of delay in turning on either of the output transistors.

Other objects of the invention will, in part, be obvious and will, in part, appear hereinafter.

The invention, accordingly, comprises the system and apparatus possessing the construction, combination of elements and arrangement of parts which are exemplified in the following detailed disclosure.

For a fuller understanding of the nature and objects of the invention, reference should be had to the following detailed description taken in connection with the accompanying drawing.

BRIEF DESCRIPTION OF THE DRAWING

The single FIGURE in the application is a schematic circuit diagram for an electronic siren formed in accordance with the teachings of the instant invention.

DETAILED DESCRIPTION

Referring to the drawing, a system providing an electronic siren function is represented generally at 10. The system 10 is suited for connection to a B+ power supply as made available within a vehicle through a connector represented at 14. Connector 14 is coupled through a conventional fuse 16 to a bus 18 which additionally incorporates a diode 20 to protect the system against reverses while diode 150 blows fuse 16, resistor 22 and diode 157. Diode 157 serves to protect the circuitry during overvoltage while resistor 22 serves a current limiting function. Bus 18 extends to a signal generator represented generally by block 24. As indicated above, signal generator 24 may take a variety of configurations well known to those artskilled and described in the above reference patents. A preferred signal generator design for the instant application at block 24 is that provided in an electronic siren identified as model 323 marketed by Signals-Stat, Corporation, of Union, N.J. The generator, when activated, serves to develop any of a variety of square wave output pulse trains selected ultimately to provide wail, hi/lo or yelp audio outputs. As noted above, these outputs generate a four second sweep of between about 650 $H_z$ to 950 $H_z$ to achieve a wail at inductively driven loud speaker 28, or a one second interval jump of from 650 $H_z$ to 950 $H_z$ to achieve a hi/lo signal thereat, or a three sweep per second excursion of frequency from 650 $H_z$ to 960 $H_z$ to evolve a yelp output. Signal generator 24 is coupled to ground through line 30, that ground simply being the chasis of a vehicle or the like. The generator 24, when energized also asserts forward biasing drive to the base of a NPN transistor $Q_1$. The collector of transistor $Q_1$ is connected through line 34 to the output of diode 20 while the emitter thereof is connected through lines 36, 38 and bias resistor 40 to line 42 as well as through line 44 and bias resistor 46 to line 48.

Lines 42 and 48, respectively, are connected to the base electrodes of NPN, push-pull power transistors $Q_2$ and $Q_3$. Preferably, each of these power transistors is present in a Darlington connected pair configuration. The collectors of transistors $Q_2$ and $Q_3$ are connected respectively through lines 50 and 52 across the primary winding of an output transformer 54 which is utilized to couple the output of the push-pull power amplification stage to loud speaker 28. A power supply connection of the center of the primary winding of transformer 54 with fuse 16 is represented by line 56.

From the foregoing, it will be apparent that, by alternately turning on or forward biasing power transistors $Q_2$ and $Q_3$ in accordance with a given command frequency, speaker 28 will be driven to achieve a desired audio output. The forward bias asserted at the base emitter electrodes of these transistors is developed from transistor $Q_1$ operating in connection with bias resistors 40 and 46. Transistor $Q_1$ serves as a switching function for asserting the B+ input from line 34 and activated at such times as the siren is operated by signal generator function 24 operating through line 32.

As indicated earlier herein, in the course of typical operation of electronic siren systems as at 10, the output transistor stages $Q_2$ and $Q_3$ have a tendency to evolve thermally generated base currents which, if unaccounted for, tend to build in value with time and, at very high operating temperatures, may lead to a thermal runaway condition causing the destruction of the output stages. The system 10 serves to accommodate for these thermally induced currents through the utilization of a very low impedance diversionary path during those intervals wherein a forward bias is not asserted at the output stages from switching transistor $Q_1$. To achieve this diversionary arrangement, output transistor stages $Q_2$ and $Q_3$ in effect, are drive to an off condition. This is carried out through the use of a control network represented generally at 60.

Network 60 includes diodes 62 and 64, respectively positioned within lines 42 and 48, which serve in their conventional role as unidirectional conductive components. The network further includes a solid state binary divider present as a D flip-flop 66. Flip-flop 66 may be one flip-flop component of a dual D flip-flop constructed preferably as a monolithic complementary MOS (CMOS) integrated circuit constructed with N and P channel enhancement transistors. Each flip-flop within the dual component has independant data (D), set (S), reset (R) and clock (C) inputs and Q and $\overline{Q}$ outputs. The logic level present at the D input is transferred to the Q output during the positive-going transition of the clock pulse. Setting or resetting is independant of the clock and is accomplished by a high level on the set or reset line respectively. Of particular interest, by imposing a high level at both the R and S terminals, both the Q and $\overline{Q}$ outputs will simultaneously assume a high level.

The square wave input of signal generator 24 is introduced to the clock input, C of flip-flop 66 through line 26. This signal, in effect, is divided by two and presented as alternating high-low values at the Q and $\overline{Q}$ terminals thereof. The $\overline{Q}$ terminal of flip-flop 66 is coupled through line 68 to an inverting buffer stage 70. Stage 70 preferably represents one half of a hex inverting buffer formed as monolithic complementary MOS (CMOS) integrated circuit constructed with N— and P— channel enhancement mode transistors. Such device features logic-level conversion using only one supply voltage. The output of stage 70 is connected with line 42 and into the above described diode 62. Similarly, the Q terminal output of flip-flop 66 is coupled through line 72 to inverting buffer stage 74 representing the opposite half of the hex buffer assembly described in connection with stage 70. Supply voltage is inserted into the hex assembly from line 76, while the assembly is coupled to ground through line 78. The output of stage 74 is connected to line 48 and into diode 64.

In operation, with the turning on of the system 10, forward bias is asserted from signal generator 24 through line 32 to the base emitter electrode of transistor $Q_1$. Transistor $Q_1$ turns on and asserts a forward biasing signal from along line 34 to line 36 and through bias resistors 40 and 46 to respective lines 42 and 48. This signal is alternately diverted to ground through diodes 62 and 64 and through respective inverter stages 70 and 74 to respective output terminals Q and $\overline{Q}$ of flip-flop 66. For example, a positive input at the $\overline{Q}$ terminal of flip-flop 66 will be inverted at inverter stage 70 to permit a low impedance path diverting to ground 40 as well as any thermally induced base leakage currents at transistor $Q_2$. Transistor $Q_2$, of course, is turned off during the interval of diversion. Simultaneously, a low value at the Q terminal of flip-flop 66 is inverted at stage 74 to back bias diode 64 and permit the assertion of a forward biasing signal to the input base electrode of transistor $Q_3$ through line 44 and resistor 46. With the inversion of the signals at outputs Q and $\overline{Q}$ of flip-flop 66, the opposite condition obtains and an appropriately oscillatory actuation of transistors $Q_2$ and $Q_3$ is carried on with the advantage that any leakage currents are disipated through the noted low impedance path.

Flip-flop 66 is enabled with the presence of a zero or low value at lines 80 or 82 extending to the R and S terminals thereof. The D terminal of the flip-flop is coupled through line 84 to a low pass filter 86 formed of capacitor 88 and resistor 90. The opposite side of capacitor 88 is coupled to ground, while resistor 90 is connected between lines 84 and 68. Filter 86 serves to protect flip-flop 66 from reversing state or toggling quickly in the presence of spurious noise spikes or the like which are commonly encountered in vehicular installations and the like. The flip-flop is rendered immune to such noise inasmuch as the filter 86 serves to limit the frequency or the rate at which the flip-flop is permitted to toggle.

System 10 further includes a soft current limiting arrangement operating in conjunction with output transistors $Q_2$ and $Q_3$. This arrangement includes a current monitoring function, shown generally at 100, which is provided as a resistor 102 coupled between ground and in common with the emitter electrodes of transistors of $Q_2$ and $Q_3$. In this regard, note that the latter electrodes are commonly coupled by line 104 which, in turn, is connected with one side of resistor 102. Monitoring function 100 operates in conjunction with a current diverter network shown generally at 106. Network 106 is formed of mutually facing diodes 108 and 110 positioned within line 112 and extending in current diverting fashion respectively from lines 42 and 48. Line 114 of the network extends from connection with line 112 intermediate diodes 108 and 110 to ground and incorporates an impedance provided as a plurality of series connected diodes represented generally at 116. Resistor 102 of monitoring function 100, by virtue of its coupling as a common emitter series resistor, develops voltage values in correspondence with the forward current of whichever transistor $Q_2$ or $Q_3$ is in an on condition. This function serves to provide added turn off bias to that transistor which is off, however, the voltage witnessed thereat will proportionally correspond with the level of current being passed by the transistor which is on. As a consequence, with the development of higher temperature operational environments or abnormally low lead impedance and correspondingly increasing current levels, a voltage responsive monitoring is carried out at resistor 102. As the voltage evolved at resistor 102 increases with current increases, diverter network 106 serves to progressively remove the otherwise asserted forward biasing input signal at an appropriate input line 42 or 48. As a consequence, that transistor $Q_2$ or $Q_3$ having an on condition will progressively lose forward bias to regulate the level of current passing thereacross. Note, that as this current controlling activity ensues, the voltage exhibited at an appropriate collector electrode will remain near that of power supply. Under these current limiting conditions imposed by monitoring function 100 and network 106, output transistors $Q_2$ and $Q_3$ are held within safe operating limits.

Because the heat dissipative capacity of the housing within which the electronics of the siren are packaged is limited, the instant invention further contemplates the utilization of a shutdown function to protect the electronics package from temperature elevations which otherwise may rise to destructive levels in a very short interval of time, for instance within about a minute or less. The shutdown technique utilizes a voltage level detector which operates in conjunction with the loss of low voltage at the collector electrode of either output transistor $Q_2$ or $Q_3$ through the association of function 100 and current diverter network 106. In this regard, the system 10 incorporates a voltage level detector network which includes line 120 within which are coupled oppositely facing diodes 122 and 124. In consequence of the connection of line 120 with line 50, diode 122 is connected with the collector of output transistor $Q_2$ while, through connection of line 120 with line 52, diode 124 is connected with the collector electrode of output transistor $Q_3$. From a position intermediate diodes 122 and 124, line 122 is coupled through line 126 to an R-C network including capacitor 128 and resistor 130. Line 126 is connected with line 131, which, in turn, couples one side of capacitor 128 to bus 18 and one terminus of resistor 130 to the Q terminal of a D flip-flop 132. Preferably forming the second component of a dual D flip-flop assembly with the above described D flip-flop 66, flip-flop 132 is utilized as the logic component of the shutdown network cooperating with the detector network components described above. D flip-flop 132 is connected within system 10 such that its C, D, and $V_{SS}$ terminals are commonly coupled through lines 134 and 136 to ground, while its $V_{DD}$ terminal is connected by line 138 to bus 18 and its set terminal, S, is coupled through line 140 and resistor 142 to line 32. The R terminal of the flip-flop is coupled through resistor 144 to line 131, while its $\overline{Q}$ output terminal is connected by the earlier described lines 80 and 82 to the R and S terminals of control network flip-flop 66.

In the normal operational mode of system 10, a high value is asserted to the set, S, input terminal of flip-flop 132 of the shutdown network. This provides a low or zero output value at line 80 which serves to enable the normal operation of flip-flop 66 of control network 60. The high input at the S terminal of flip-flop 132 also provides for a high value at the Q output terminal thereof. Thus configured, the high signal value at the Q output of flip-flop 132 will tend to charge capacitor 128 through resistor 130. However, inasmuch as output transistors $Q_2$ and $Q_3$ alternately are saturated in the course of normal operation, capacitor 128 continuously with be pulled down through lines 132, 126 and 120 by virtue of the output transistor collector terminal associations of diodes 122 and 124. For example, when output transistor $Q_2$ is in a saturated on condition, capacitor 128 will be drawn down through diode 122, while, conversely, when output transistor $Q_3$ assumes a saturated on condition capacitor 128 will be drawn down through diode 124. With the occurence of a short within the system 10, however, current will tend to increase through output transistors $Q_2$ and $Q_3$, thus bringing into operation the circuit monitoring function 100 and current diverter network 106. As a consequence, the loss of low voltage at either of the collector electrodes of output transistors $Q_2$ or $Q_3$ will inhibit the draw down capability of the voltage level detector function including diodes 122 and 124. Stated otherwise, output transistors $Q_2$ and $Q_3$ will have only limited available current to pull a short circuit such that the collector electrodes thereof will stay near the power supply. Diodes 122 and 124 no longer will perform to hold down capacitor 128. The resultant high value developed following the time constant interval of the R-C network including resistor 130 and capacitor 128 will force the R terminal of D flip-flop 132 to a correspondingly high level. The high level imposed at the R terminal, in turn, causes the $\overline{Q}$ terminal to assume a high level which is asserted at the R and S terminals of flip-flop 66. As indicated earlier, with the simultaneous assertion of a high level to the R and S terminals of flip-flop 66, a simultaneous high value is developed at the Q and $\overline{Q}$ terminals of the flip-flop. These simultaneously derived high values then are inverted at inverter stages 70 and 74 which serve to divert the forward bias signal available through switching transistor $Q_1$ and bias resistors 40 and 46 through the earlier described low impedance path to ground. A shutdown of output transistors $Q_2$ and $Q_3$ also obtains when system 10 is in a nonoperational mode inasmuch as capacitor 128 will be initially charged to a high value which is reflected through the $\overline{Q}$ terminal of flip-flop 132 as a high level signal which, in turn, is witnessed at the R and S terminals of flip-flop 66. In similar fashion, should an attempt be made to start the unit into a preexisting short circuit, capacitor 128 will be charged to cause the shutdown function of the system 10 within a very short interval, i.e. the few millisecond time constant of the R-C circuit including capacitor 128 and resistor 130.

Another feature of the system 10 resides in the mutual isolation of the intervals of alternate saturation of output transistors $Q_2$ and $Q_3$. This isolation is assured through the provision of an overlap preventing capacitor 146 within line 148 extending between lines 42 and 48. Capacitor 146 develops a small time gap between the turning off of one of the output transistors and the turning on of the other. This is accomplished inasmuch as the turning off interval is substantially instantaneous since the forward bias signal emanating from transistor $Q_1$ is diverted through a low impedance path as described in detail above. However, when forward bias is alternately asserted at transistor stages $Q_2$ and $Q_3$, the forward biasing signal is developed in accordance with the time constant of either resistor 40 or resistor 46 operating in conjunction with capacitor 146. The minor time constant evolved, i.e. a few microseconds introduces the noted time gap between the turning off of one output transistor and the turning on of the other. Because of the inductive load involved, a small spike will appear within the system during this developed gap. The spike is accommodated for by the filter represented by earlier described capacitor 128 and resistor 130. Without this filtering activity, the system would shut down following one half cycle of operation.

Other protective features of the system 10 include the incorporation of reversed bias diodes (not shown) connected in conventional manner to shunt the output transistors $Q_2$ and $Q_3$. Such a diode shunting function is inherent in the Darlington type transistors identified below and preferred for use at transistor stages $Q_2$ and $Q_3$, however, where discrete forms of power transistors are used at the output stage function, then the shunting diode should be incorporated. The power input to system 10 also reveals the presence of a diode 150 coupled within line 152 which, in turn, is connected to ahead of bus line 18 at one side of fuse 16. Coupled to ground as shown, diode 150 serves to protect the entire circuit from an inadvertent installation wherein polarity is reversed, i.e. the circuit is wired backwards. If so wired, diode 150 will cause the blowing of fuse 16. A capacitor 154 coupled within line 156 to ground from bus 18 serves the conventional purpose of providing a power supply filter.

Another advantageous feature of the shutdown and voltage level detection arrangement of the invention resides in its performance in the event of a failure within the pulse train deriving operation of signal generator 24. Assuming such a failure, the pulse train signal asserted at line 26 to the clock input, C, of D flip-flop 66 will cease. When this occurs, the entire system 10 will hold all logic levels present at the point in time of failure within signal generator 24. As a consequence, that output transistor $Q_2$ or $Q_3$ which had been forward biased on to saturation will remain on. Without correction, the characteristic of the reactive load of the transformer 54 will cause electric current to rise exponentially. As the current so rises, the current monitoring function at 100 and corresponding current diverter network 106 will respond to cause the voltage level detector network, including diodes 122 and 124, to, in turn, respond to permit the charging of capacitor 128 and consequent activation of the shutdown function of D flip-flop 132. Thus, system 10 is immune from a broad variety of otherwise debilitating shorts and operational failures.

In a production model of an electronic siren circuit structured in accordance with the present invention, the following significant component values and standard integrated circuit designations were used for the identified components. All resistors were carbon having a ±5% tolerance except as noted.

| RESISTORS | | | |
|---|---|---|---|
| NO. | VALUE | NO. | VALUE |
| 22 | wirewound 120 ohm | 102 | 0.1 ohm 7 watt |

-continued

RESISTORS

| NO. | VALUE | NO. | VALUE |
|---|---|---|---|
| | ½ watt | | |
| 40 | 680 ohm | 130 | 82 K |
| 46 | 680 ohm | | |
| 90 | 47 K | | |

CAPACITORS

| NO. | VALUE |
|---|---|
| 88 | 0.005 MFD Mylar |
| 128 | 0.02 MFD Mylar |
| 146 | 0.047 MFD Mylar |

DIODES

| NO. | VALUE |
|---|---|
| 20 | Silicon IN4001 |
| 62, 64 | Silicon IN4148 |
| 108, 110, 116 | Silicon IN4001 |
| 122, 124 | Silicon IN4148 |
| 150 | Silicon IN5400 |

TRANSISTORS AND INTEGRATED CIRCUITS

| NO. | VALUE |
|---|---|
| Q-1 | 2N3569 |
| Q-2, Q-3 | 2N6576 |
| Dual D flip-flops 166, 132 | IC CMOS 4013 |
| Hex Buffer Inverter 70, 74 | IC CMOS 4049 |

TRANSFORMER

| NO. | DESIGNATION |
|---|---|
| 54 | 8OP32 |

Clearing the system shut-down memory function is straightforward. Returning to a standby condition, line 32 is turned off. This, in turn drops the S input at flip-flop 132 which drops the Q terminal thereof in turn allowing the R terminal to drop, $\overline{Q}$ remaining high. Going from standby back into operation, since R is low, $\overline{Q}$ may be dropped and the system resumes operation.

Since certain changes may be made in the above-described improved electronic siren without departing from the scope of the invention herein involved, it is intended that all matter contained in the above description or shown in the accompanying drawing shall be interpreted as illustrative and not in a limiting sense.

What is claimed is:

1. In an electronic siren of a variety including a sound reproducing device representing a reactive load, first and second output transistor stages responsive to forward bias input signals for providing a square wave drive to said load and signal generating means for providing pulse train input signals, the improvement comprising:

solid state switching means for asserting said forward bias input signals at said first and second power transistor stages to effect a saturated on condition thereof; and control network means coupled with said first and second output transistor stages, and with said signal generating means and responsive to said pulse train input signals for alternately diverting said forward bias input signals through a low impedance path from said first and second output transistor stages to effect said square wave drive, whereby thermally induced leakage currents are diverted in conjunction with said forward bias input signals.

2. The improved electronic siren of claim 1 in which said control network means comprises a solid state binary divider having an input for receiving said pulse train input signals and first and second output transistor stages and said solid state switching means.

3. The improved electronic siren of claim 2 wherein said control network means includes first solid state junction-type unidirectional conductive means connected between said binary divider first output and said first output transistor stage, and second solid state junction-type unidirectional conductive means connected between said second binary divider second output and said second output transistor stage.

4. The improved electronic siren of claim 1 wherein said first and second output transistor stages include respective first and second collector electrodes coupled with said load, first and second input base electrodes coupled to receive said forward bias input signals and respective first and second emitter electrodes, and including:

a current diverter network connected between said first and second input base electrodes and having a predetermined voltage threshold characteristic;

current monitoring impedance means coupled in common series circuit relationship with each said first and second emitter electrodes and exhibiting a predetermined impedance value;

said current diverter network and said current monitoring impedance means having respective said threshold characteristic and impedance values such that said diverter network means progressively diverts said forward bias input signals in the presence of emitter current derived predetermined voltage levels at said current monitoring impedance means.

5. The improved electronic siren of claim 4 in which said control network means comprises a solid state binary divider having an input for receiving said pulse train input signals and first and second outputs connected with respective said first and second output transistor stage input base electrodes and said solid state switching means.

6. The improved electronic siren of claim 5 wherein said control network means includes first solid state junction-type unidirectional conductive means connected between said binary divider first output and said first output transistor stage, and second solid state junction-type unidirectional conductive means connected between said second binary divider second output and said second output transistor stage.

7. The improved electronic siren of claim 1 including:

voltage level detector means coupled with said collector electrodes of said first and second output transistor stages and having a predetermined output condition when the voltage value exhibited at a said collector electrode represent a non-saturated on condition;

shutdown network means coupled with said control network means and said voltage level detector means and responsive to said predetermined output condition for deriving a disable signal at said control network means effecting the simultaneous diversion of said forward bias input signals through said low impedance path from said first and second output transistor stages.

8. The improved electronic siren of claim 7 in which said voltage level detector means comprises:

capacitor means;

means continuously asserting a charge upon said capacitor means; and charge diverting means coupled between said capacitor and said collector electrodes of said first and second output transistor stages for diverting said charge at said capacitor means only when said output transistor stages exhibit a saturated on condition.

9. The improved electronic siren of claim 8 in which said enabling network means comprises a bi-stable network having an input terminal responsive to a developed charge at said capacitor means for asserting said disable signal at said control network means.

10. The improved electronic siren of claim 1 including capacitor means coupled intermediate said first and second power transistor stages for selectively delaying the alternate assertion of said forward bias input signals thereupon.

11. The improved electronic siren of claim 10 in which said bi-stable network is present as a D flip-flop circuit having R and Q terminals coupled through resistor means to said capacitor means, and having a $\overline{Q}$ terminal coupled with said control network means for asserting said disable signal.

12. The improved electronic siren of claim 11 in which said control network means comprises:

a D flip-flop circuit having a C input terminal for receiving said pulse train input signals, a Q terminal coupled with said first output transistor stage base electrode, a $\overline{Q}$ terminal coupled with said second output transistor stage base electrode and R and S terminals with said bi-stable network $\overline{Q}$ terminal;

a first inverter connected intermediate said control network means Q terminal and said first output transistor stage;

a second inverter connected intermediate said control network means $\overline{Q}$ terminal and said second output transistor stage;

first unidirectionally conductive means connected intermediate said first inverter and said first output transistor stage;

second unidirectionally conductive means connected intermediate said second converter and said second output transistor stage;

said solid state switching means being connected intermediate said first and second unidirectionally conductive means and first and second output transistor stages.

13. The improved electronic siren of claim 12 including capacitor means coupled intermediate first and second power transistor stages for selectively delaying the alternate assertion of said forward bias input signals thereupon.

14. The improved electronic siren of claim 12 including a low pass filter network coupled with the D terminal of said D flip-flop circuit for prohibiting the development of noise induced transitions at the Q and $\overline{Q}$ terminals thereof.

15. In an electronic siren of a variety including a sound reproducing device representing an inductive load, first and second output transistor stages responsive to asserted forward bias signals for providing a drive to said load, each said output transistor stage including base, collector and emitter electrodes and circuit means for effecting an alternate assertion of said forward bias signals at said first and second output transistor stages, the improvement comprising:

a current diverter network connected between the said base electrodes of said first and second output transistor stages and having a predetermined threshold characteristic value;

current monitoring impedance means coupled in series circuit relationship with said emitter electrodes of said first and second output transistor stages and having a predetermined impedance value; and said current diverter network and said current monitoring impedance means having respective said threshold characteristics and impedance values such that said diverter network means serves to progressively divert said forward bias input signal in the presence of emitter current derived predetermined voltage levels at said current monitoring impedance means.

16. The improved electronic siren of claim 15 further comprising:

control network means forming a component of said circuit means and coupled with said first and second output transistor stages for controlling, in the absence of a disable signal asserted thereto the said assertion of said forward bias signals;

voltage level detector means coupled with said collector electrodes of said first and second output transistor stages and having a predetermined output condition when the voltage values exhibited at a said collector electrode represent a non-saturated on condition; and shutdown network means coupled with said control network means and said voltage level detector means and responsive to said predetermined output condition for asserting a disable signal at said control network means effecting the simultaneous removal of said forward bias input signals at said first and second output transistor stages.

17. The improved electronic siren of claim 16 in which said voltage level detector means comprises:

capacitor means;

means continuously asserting a charge upon said capacitor means; and charge diverting means coupled between said capacitor and said collector electrodes of said first and second output transistor stages for diverting and charge at said capacitor means only when said output transistor stages exhibit a saturated on condition.

18. The improved electronic siren of claim 17 in which said shutdown network means comprises a bistable network having an input terminal responsive to a developed charge at said capacitor means for asserting said disable signal at said control network means.

19. The improved electronic siren of claim 15 including capacitor means coupled intermediate said first and second power transistor stage base electrodes for selectively delaying the alternate assertion of said forward bias input signals thereupon.

20. The improved electronic siren of claim 18 in which said bi-stable network is presentas a D flip-flop circuit having R and Q terminals coupled through resistor means to said capacitor means, and having a $\overline{Q}$ terminal coupled with said control network means for asserting said disable signal.

* * * * *

UNITED STATES PATENT OFFICE

CERTIFICATE OF CORRECTION

Patent No. 4,180,809 Dated December 25, 1979

Inventor(s) Robert S. Feldstein

It is certified that error appears in the above-identified patent and that said Letters Patent are hereby corrected as shown below:

| | |
|---|---|
| Col. 1, lines 26-27 | delete "to those artskilled" |
| Col. 1, line 41 | change "etcetra" to --etcetera-- |
| Col. 1, lines 66-67 | delete "occur to those artskilled as" and insert --appear to be-- |
| Col. 2, line 13 | change "disipation" to --dissipation-- |
| Col. 3, line 46 | after "20" insert --resistor 22 and diode 157-- |
| Col. 3, lines 47-48 | delete ", resistor 22 and diode 157" |
| Col. 3, lines 52-53 | after "variety of" insert --well known-- and delete "well known to those artskilled and" |
| Col. 4, line 30 | after "course of" insert --the-- |
| Col. 4, line 31 | after "of" insert --a-- and change "systems" to --system-- |
| Col. 4, line 43 | change "drive" to --driven-- |
| Col. 4, line 66 | delete the comma after "input" |
| Col. 5, line 40 | change "disipated" to --dissipated-- |
| Col. 6, line 23 | after "of" insert --the-- |
| Col. 7, line 19 | after "condition" insert a comma |

UNITED STATES PATENT OFFICE

CERTIFICATE OF CORRECTION

Patent No. 4,180,809 Dated December 25, 1979

Inventor(s) Robert S. Feldstein

It is certified that error appears in the above-identified patent and that said Letters Patent are hereby corrected as shown below:

| | |
|---|---|
| Col. 7, line 20 | change "occurence" to --occurrence-- |
| Col. 8, line 26 | delete "reveals the presence of" and insert --includes-- |
| Col. 8, lines 27-28 | delete "ahead of" and after "18" insert --ahead of diode 20 and-- |
| Col. 9, line 43 | change "standby" to --stand-by-- |
| Col. 9, line 47 | change "standby" to --stand-by-- |
| Col. 10, line 11 | insert after "second" --outputs connected with respective said first and second-- |
| Col. 10, line 35 | after the semi-colon insert --and-- |
| Col. 10, line 65 | after the semi-colon insert --and-- |
| Col. 11, lines 11-12 | after "capacitor" insert --means-- |
| Col. 12, line 27 | after "thereto" insert a comma |
| Col. 12, line 47 | after "capacitor" insert --means-- |
| Col. 12, line 48 | change "and" to --said-- |

UNITED STATES PATENT OFFICE

CERTIFICATE OF CORRECTION

Patent No. 4,180,809 Dated December 25, 1979

Inventor(s) Robert S. Feldstein

It is certified that error appears in the above-identified patent and that said Letters Patent are hereby corrected as shown below:

Col. 12, line 63 change "presentas" to --present as--.

Signed and Sealed this

*Twenty-second* Day of *April 1980*

[SEAL]

*Attest:*

SIDNEY A. DIAMOND

*Attesting Officer* *Commissioner of Patents and Trademarks*